United States Patent [19]

Gasser

[11] 4,090,443

[45] May 23, 1978

[54] DRIVEN SQUEEGEE CARRIAGE AND MAGNETIC BEAM BACKUP

[75] Inventor: Manfred Gasser, Klagenfurt, Austria

[73] Assignee: Johannes Zimmer, Klagenfurt, Germany

[21] Appl. No.: 726,257

[22] Filed: Sep. 24, 1976

[30] Foreign Application Priority Data

| | | |
|---|---|---|
| Oct. 2, 1975 | Germany | 7531294 |
| Oct. 3, 1975 | Austria | 7591/75 |

[51] Int. Cl.[2] ..... B41F 15/46

[52] U.S. Cl. ..... 101/123; 118/258; 118/406

[58] Field of Search ..... 101/119, 120, 123, 124; 118/213, 406, 258, 414

[56] References Cited

U.S. PATENT DOCUMENTS

| | | | |
|---|---|---|---|
| 2,571,685 | 10/1951 | D'Autremont | 101/123 |
| 3,196,784 | 7/1965 | Kraft | 101/123 |
| 3,650,208 | 3/1972 | Lambert | 101/123 |
| 3,795,189 | 3/1974 | Jaffa | 101/123 |

FOREIGN PATENT DOCUMENTS

| | | | |
|---|---|---|---|
| 1,270,577 | 6/1968 | Germany | 101/123 |
| 879,906 | 10/1961 | United Kingdom | 101/123 |

*Primary Examiner*—Ronald E. Suter

*Attorney, Agent, or Firm*—Haseltine, Lake & Waters

[57] ABSTRACT

A device for treating a web or the like adapted for screen printing including a magnetizable wiping roller or squeegee mounted on a working carriage, a printer's blanket carrying the web, a magnetic beam disposed below the printer's blanket, and rails rollably supporting the magnetic beam. The magnetizable wiping roller is urged towards the web through movement of the working carriage in the longitudinal direction of the printers blanket, and guided thereover by the magnetic beam in the course of printing on the web. The web is stationary during treatment. An electric motor is provided for moving the magnetic beam and the motor drives at least one drive wheel engageable with the rails for moving the beam. Speed and position of the wiping roller is determined by a sensor arrangement responsive to deviation of the working carriage from the magnetic beam path.

3 Claims, 3 Drawing Figures

DRIVEN SQUEEGEE CARRIAGE AND MAGNETIC BEAM BACKUP

BACKGROUND OF THE INVENTION

1. Field of the Invention

The invention relates to a device for the treatment of webs or the like, particularly for screen printing, comprising at least one magnetizable working element, particularly a wiper roller or squeegee urged by a magnetic beam towards the web and guided thereover, the web being stationary during the treatment process, the web being interposed between the wiper roller and the beam, the latter being movable on rollers.

2. Description of the Prior Art

Apparatus of this type is particularly used for flat screen printing and therein a magnetic beam is associated with each printing station and is movable along the web. A wiper roller of magnetizable material is displaced in a flat-type screen by displacement of the magnetic beam so that colorant is imprinted on the web. Subsequently, the magnets on the beam are switched off, the flat screen together with the wiper rollers disposed therein are lifted up, and the web, which is attached to a belt or printer's blanket is moved along. In printing machines employing a longitudinal table, the forward movement of the belt does not take place, and a single flat or curved screen is moved either stepwise, or continuously, above a single magnetic beam. According to an upublished proposal, the magnetic beam can also extend in the longitudinal direction of the web and be movable transversely to the latter.

The movement of the magnetic beam has hitherto always been accomplished from the narrow side of the device, whereby a rigid coupling has been provided between the individual beams by means of longitudinally disposed tubes or the like. A rigid coupling of the magnetic beams of this type is always disadvantageous, if a change in the length of the screen is to be made. If only a single magnetic beam is to be employed, it is uneconomical to provide drive means, for example a chain drive, extending over the whole length of the device, since the length of such a device can easily reach 30 meters and more.

SUMMARY OF THE INVENTION

Devices of the above-described type are simplified, according to the invention, by the provision of at least one motor, preferably an electric motor, on the magnetic beam for effecting the movement of the beam, the motor driving at least one drive wheel.

The invention is also particularly applicable to a printing device for film- or screen-printing having a longitudinal table, rails disposed at the longitudinal rims or edges of the table, and printing or auxiliary devices coupled to a drive motor and slidably or rollably arranged on the rails.

In printing devices of this type, the web to be imprinted is pasted on the belt or printer's blanket which extends in the longitudinal and transverse directions of the longitudinal table. Curved or flat screens are displaceable on rails in the longitudinal direction of the table, the individual colors of a sample being sequentially coated on the web. Following the printing process, the product is taken off the table and transported to a drying device. Any color and paste residues must be cleaned from the table plate or the printer's blanket prior to pasting a new web on the plate or blanket.

Special cleaning and pasting-carriages are used for cleaning off the table surface, for applying the paste coating on the blanket, and for attachment of the blanket onto the table surface. These carriages are denoted hereafter as "auxiliary devices," and these are continually moved in the longitudinal direction of the table. The flat screen printing carriages are displaced between successive printing stages over a length by manual action. Rotary printing rollers and/or printing-devices, as well as the auxiliary devices are displaceable at a uniform velocity in the longitudinal direction, the printing rollers rolling on said screen.

If the magnetic beam of a device of this type is made to be self-propelling in accordance with the invention, then this is advantageous to the extent that the problem of synchronization with devices displaceable above the printer's blanket is easily solved. Preferably, contactless sensor means are provided for control of synchronization between the magnetic beam and the printing- or auxiliary-devices for determining the position of the printing- or auxiliary-devices relative to the magnetic beam, said sensor means controlling the drive motor of the magnetic beam or the printing- or auxiliary-devices upon detection of any deviation from the normal synchronized position.

Even a relatively small movement between the magnetic beam driven below the printing blanket, and the printing- or auxiliary-devices, driven above the printer's blanket (by a separate drive), triggers a correction signal for the control circuit of one of the drives. Thus, complicated devices embracing the printer's blanket, such as, for example, rope lifts which are prone to malfunction, ae avoided.

BRIEF DESCRIPTION OF THE DRAWING

The invention is illustrated in greater detail with reference to the drawing in which.

DESCRIPTION OF THE PREFERRED EMBODIMENTS

Figure 1:
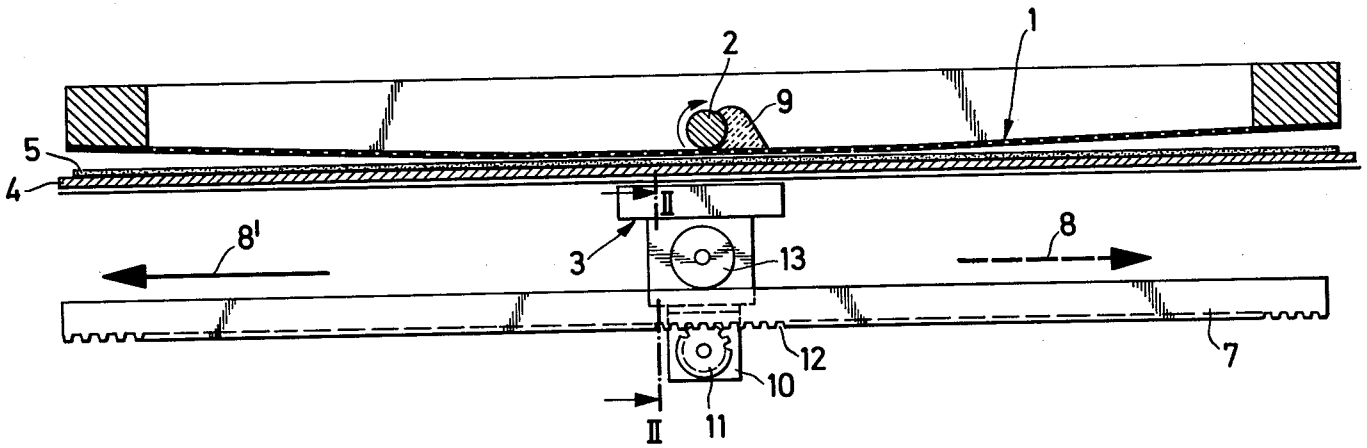
FIG. 1 is a schematic side view of one embodiment according to the invention.

FIG. 1 shows a screen printing station of a screen printing machine having flat screens 1. In flat screen 1 there is disposed a wiper roller or squeegee 2 of magnetizable material, which is attracted by a magnetic beam 3, the latter having an upper surface forming a printing support. A conveyor belt or printer's blanket 4 is disposed between the magnetic beam 3, and the screen 1 and a web 5 to be screen-printed is adhesively secured to the belt and travels therewith.

The wiper roller 2 is driven longitudinally by movement of the magnetic beam 3 on stationary rails 7 in the direction of the arrows 8 and/or 8' and the roller travels in contact on the screen 1 which is stationary relative to the conveyor belt 4. Due to the contact of the roller with the screen, the roller 2 rolls on the inner surface of the flat screen 1 in the course of its longitudinal travel and thereby imprints a colorant 9 through sieve-like openings of the screen onto the web 5.

Figure 2:
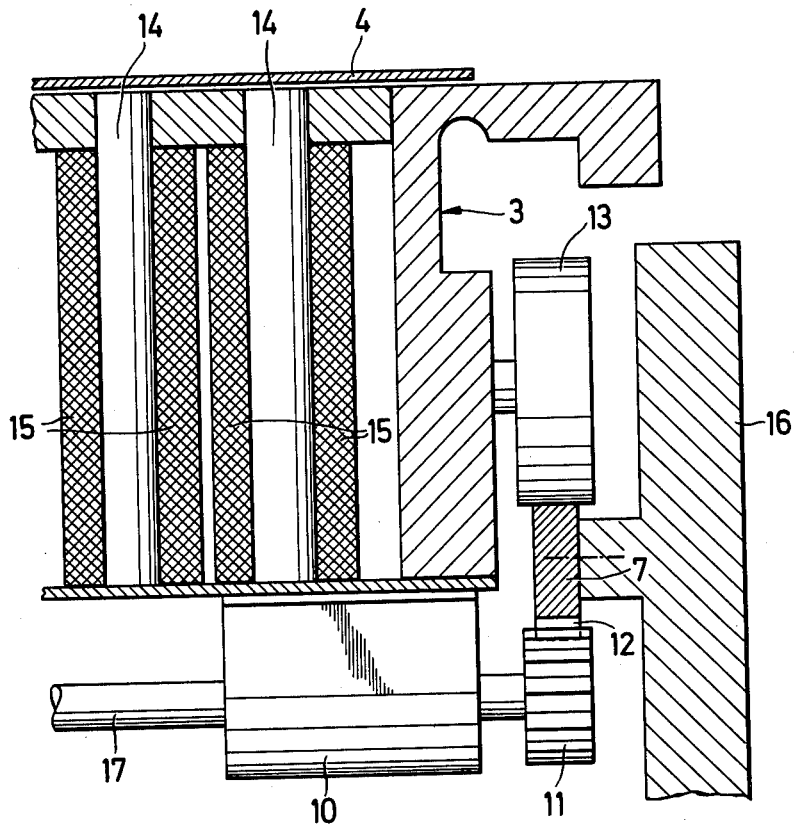
FIG. 2 is an enlarged cross-section of a detail of FIG. 1.

The magnetic beam 3, best seen in FIG. 2, includes a plurality of magnetic cores 14 disposed successively in a row, the cores 14 being surrounded by respective windings 15. A motor 10 is carried on the underside of the beam to drive a toothed wheel 11 which meshes with teeth 12 on the lower surface of rails 7 to cause the beam to travel along the rails. The beam carries rollers 13 which roll on the smooth upper surface of the rails 7 to facilitate the travel of the beam. If an attempt was made to directly drive the magnetic beam on the rails 7 by forming teeth on the upper surface there would not be obtained a smooth and quiet operation to the same degree as is required in screen printing.

The rails 7 are carried by posts 16 disposed along web 5. The same arrangement is also provided on the left end of the magnetic beam 3 (not shown) where an additional toothed wheel corresponding to the toothed wheel 11, is driven by a shaft 17 from motor 10.

Figure 3:
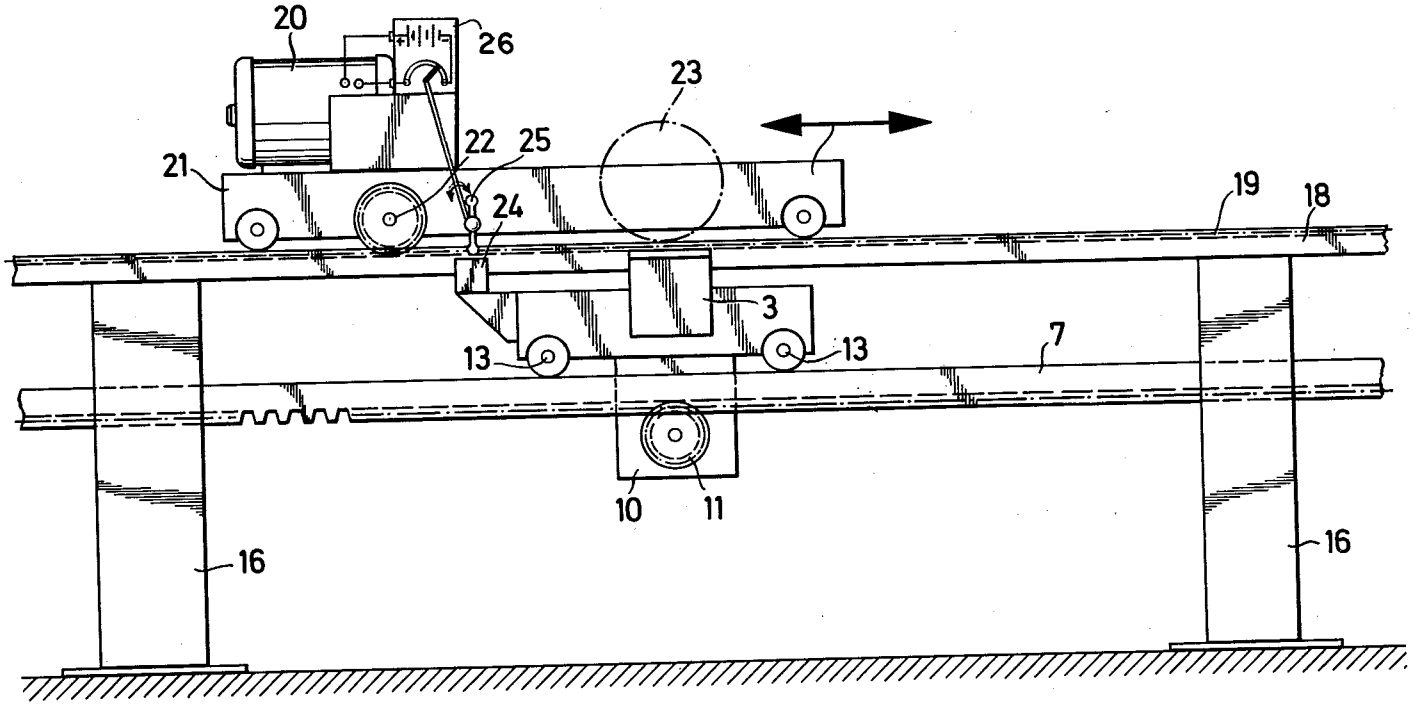
FIG. 3 is a schematic side view of a longitudinal table-type printing-machine, according to the present invention.

In a modified arrangement shown in FIG. 3, the same reference numerals are employed to refer to similar structure in FIG. 1. The machine frame consists essentially of the posts 16, which are joined to one another in the longitudinal and transverse directions by braces, the frame carrying the rails 7 for the magnetic beam 3, as well as profiles or sections 18 for the support and tensioning of a printer's blanket. Toothed racks 19 are disposed on the longitudinal sides of sections 18. Inner flanges of sections 18 serve as rails for displacement of a carriage 21 provided with a drive means 20 for displacing the carriage in the longitudinal direction of the frame, together with printing- and auxiliary devices disposed on the carriage 21. The longitudinal displacement of the carriage 21 is achieved by driving toothed wheels 22 from drive means 20, the toothed wheels 22 being in mesh with the rack 19. The magnetic beam 3 is disposed on rails 7 for travel below the printer's blanket, and the beam 3 serves as an abutment for the devices moving above the web, as well as a bearing support for exerting counterpressure against wiper roller 23 which is supported on the carriage 21. The rotational speed of the drive means 20 and the motor 10 are controlled so that the magnetic beam 3 and the carriage 21 always remain in the same longitudinal position with respect to one another. The synchronization provided between the magnetic beam 3 and the carriage 21 is shown schematically in FIG. 3 of the drawing.

A permanent magnet 24 is disposed on the magnetic beam carriage and is located a small distance from the web, said permanent magnet facing a magnetizable pendulum 25 disposed on the carriage 21 to cause the pendulum to pivot if it is displaced from a predetermined position with respect to the magnetic beam 3. A potentiometer 26 is connected to and operated by the pendulum 25 to furnish indication of the relative longitudinal positions of carriage 21 and beam 3 and in order to re-adjust the positions thereof to the pre-determined positions, the potentiometer acts in a control circuit of the motor 20 such that the speed of the motor 20 is adjusted such that the carriage 21 will by synchronized in longitudinal position with the magnetic beam 3.

It is also possible within the bounds of the invention to reverse the relative positions of the permanent magnet 24 and the pendulum 25.

What is claimed is:

1. An apparatus for screen type-printing of webs (5) comprising: a print blanket (4) carrying a web (5) to be treated; a magnetic beam (3) disposed below said web (5); first rail means (7) rollably supporting said magnetic beam (3) in a longitudinal direction of said print blanket (4); first motor means (10) for moving said magnetic beam (3), said first motor means (10) having at least one drive wheel (11) engageable with said first rail means (7); said magnetic beam (3) being provided with a supporting surface for said blanket (4), said surface being disposed beneath said blanket (4) and a magnetic squeegee means (2); said magnetic squeegee means (2) being mounted in a working carriage (21) above said web (5) and being attractable to said magnetic beam (3); said working carriage (21) being rollably supported in the longitudinal direction of said print blanket (4) by second rail means (18), said working carriage having second motor means (20) for rollable movement on said second rails (18); and contactless sensor means operable in response to deviation in the longitudinal position of said working carriage from said magnetic beam to thereby control the speed of one of said motor means.

2. An apparatus for screen type-printing of webs (5) comprising: a print blanket (4) carrying a web (5) to be treated, a magnetic beam (3) disposed below said web (5); first rail means (7) rollably supporting said magnetic beam (3) in the longitudinal direction of said print blanket (4); first motor means (10) for moving said magnetic beam (3), said first motor means (10) having at least one drive wheel (11) engageable with said first rail means (7); said magnetic beam (3) being provided with a supporting surface for said blanket (4), said surface being disposed beneath said blanket (4) and a magnetic squeegee means (2); said magnetic squeegee means (2) being mounted in a working carriage (21) above said web (5) and being attractable to said magnetic beam (3), said working carriage (21) being rollably supported in the longitudinal direction of said print blanket (4) by second rail means (18), said working carriage having second motor means (20) for rollable movement on said second rails (18); and contactless sensor means comprising a permanent magnet disposed on said magnetic beam and a pivotable pendulum disposed on said working carriage cooperating with said permanent magnet and being angularly displaceable upon relative movement of said working carriage and said magnetic beam, said sensor means being operable in response to deviation in the longitudinal position of said working carriage from said magnetic beam to thereby control the speed of one of said motor means.

3. An apparatus for screen type-printing of webs (5) comprising: a print blanket (4) carrying a web (5) to be treated, a magnetic beam (3) disposed below said web (5), first rail means (7) rollably supporting said magnetic beam (3) in the longitudinal direction of said print blanket (4); first motor means (10) for moving said magnetic beam (3), said first motor means (10) having at least one drive wheel (11) engageable with said first rail means (7); said magnetic beam (3) being provided with a supporting surface for said blanket (4), said surface being disposed beneath said blanket (4) and a magnetic squeegee means (2); and magnetic squeegee means (2) being mounted in a working carriage (21) above said web (5) and being attractable to said magnetic beam (3), said working carriage (21) being rollably supported in the longitudinal direction of said print blanket (4) by second rail means (18), said working carriage having second motor means (20) for rollable movement on said second rails (18); and contactless sensor means operable in response to deviation in the longitudinal position of said working carriage from said magnetic beam, said contactless sensor means comprises a permanent magnet disposed on said magnetic beam and a pivotable pendulum disposed on said working carriage cooperating with said permanent magnet and being angularly displaceable upon relative movement of said working carriage and said magnetic beam, said pivotable pendulum being coupled to a potentiometer for controlling the speed of one of said motor means.

* * * * *